United States Patent [19]

Brown

[11] Patent Number: 4,865,122

[45] Date of Patent: Sep. 12, 1989

[54] AGGREGATIVELY FLUIDIZED LIQUID HEAT EXCHANGER

[75] Inventor: Robert C. Brown, Ames, Iowa

[73] Assignee: Iowa State University Research Foundation, Inc., Ames, Iowa

[21] Appl. No.: 194,155

[22] Filed: May 16, 1988

[51] Int. Cl.[4] ..... F28D 13/00

[52] U.S. Cl. ..... 165/104.16; 122/4 D

[58] Field of Search ..... 165/104.16; 122/4 D

[56] References Cited

U.S. PATENT DOCUMENTS

| | | | |
|---|---|---|---|
| 2,751,756 | 6/1956 | Hughes et al. | 165/104.16 |
| 3,075,580 | 1/1963 | Davis, Jr. | 165/104.16 |
| 4,499,944 | 2/1985 | Komakine | 165/104.16 |
| 4,616,698 | 10/1986 | Klaren | 165/104.16 |

FOREIGN PATENT DOCUMENTS

| | | | |
|---|---|---|---|
| 175492 | 8/1986 | Japan | 165/104.16 |
| 901798 | 1/1982 | U.S.S.R. | 165/104.16 |
| 1145236 | 3/1985 | U.S.S.R. | 165/104.16 |
| 2077615 | 12/1981 | United Kingdom | 165/104.16 |

*Primary Examiner*—Albert W. Davis. Jr.

*Attorney, Agent, or Firm*—Zarley, McKee, Thomte, Voorhees & Sease

[57] ABSTRACT

A heat exchanger for enhanced heat exchange between first and second liquids includes a shell enclosure in which is positioned a bed material supported on a plate distributor. One or more tube enclosures are positioned through the bed material of the shell enclosure, and themselves contain bed material supported upon a distributor plate. The first liquid is passed through the bed material of the shell enclosure so as to fluidize the bed material. The second fluid, of different temperature, is passed through the bed material of each tube means. Heat is transferred between the fluids, and the transfer is enhanced by nature of fluidization of both beds.

22 Claims, 1 Drawing Sheet

AGGREGATIVELY FLUIDIZED LIQUID HEAT EXCHANGER

BACKGROUND OF THE INVENTION

1. Field of the Invention

The present invention relates to heat exchange, and more particularly, to a means and method for enhanced heat exchange between two liquids.

2. Problems in the Art

A common method of exchanging heat between fluids is to position an enclosure or conduit of one of the fluids within the conduit or enclosure of the other of the fluids. By circulating one or both of the fluids through their respective conduits or enclosures, heat is transferred, by convection, from the hotter fluid to the cooler fluid.

It is also known that with regard to gases, heat transfer can be significantly improved over mere convection, by fluidizing one or both of the conduits or enclosures, utilizing bed materials of small particles. It has been discovered that the gas bubbles created in such a fluidized bed, by nature of the interaction of the gas flowing through the bed material, causes agitation of the particles, which in turn causes greater and more frequent interaction between the particles and the sides of the conduit or enclosure, thereby increasing heat exchange rate.

Fluidizing a heat exchanger for transfer of heat between two gases, so that such gas bubbles are produced, is known as aggrevative fluidization. Whereas these principles are known and have been effectively utilized in gas-to-gas heat transfer, they have not been satisfactorily applied in liquid-to-liquid heat transfer. There is thus a real need for increased or enhanced heat transfer between liquids of different heat content.

A significant difficulty in solving this problem exists in the fact that liquid fluidized beds do not generally carry liquid bubbles. If bubbles do not form, then the particle agitation characteristic of aggravated fluidization does not occur.

Therefore, it is a principal object of the present invention to provide a heat exchanger means and method which solves or improves over the problems and deficiencies in the art.

A further object of the present invention is to provide a means and method as above described which can provide effective and enhanced heat transfer between two liquids.

Another object of the present invention is to provide a means and method as above described which produces not only enhanced heat transfer, but also enhanced control of the rate of heat transfer.

A further object of the present invention is to provide a means and method as above described which facilitates aggregative fluidization to enhance heat transfer.

A further object of the present invention is to provide a means and method as above described which is easily adaptable for a number of uses, materials, and heat transfer requirements.

Another object of the present invention is to provide a means and method as above described which is efficient, economical, and non-complex.

These and other objects, features, and advantages of the invention will become more apparent with reference to the accompanying specification and claims.

SUMMARY OF THE INVENTION

The present invention is a means and method for enhanced heat transfer or exchange between two liquids of different heat content. The invention centers on providing a heat exchange interface between the conduits or enclosures containing the liquids, and further including an environment wherein heat exchange is enhanced.

The first liquid is directed or circulated through a shell enclosure which contains a bed material supported on a distribution plate. The pressure or force of the liquid is controlled to a level whereby the bed material is fluidized by the liquid flow.

Tube containers or enclosures are positioned in the bed material of the shell enclosure, and similarly, each tube includes bed material supported on a distribution plate. The second liquid is likewise directed at a sufficient pressure through the tube so that the bed material is fluidized.

The heat transfer interface area is generally described as the fluidized bed portions of each tube which are co-extensive with the fluidized bed portion of the shell. The fluidization of both the shell and tube beds thus enhance heat transfer in each tube and shell bed, through the walls of each tube, and then between each bed.

The adaptability of the present invention to create enhanced heat transfer hinges on the fact that if one or more of the liquids is boiling, gas bubbles will be produced and thereby cause increased agitation and heat transfer properties. If, however, boiling will not generally occur in either the shell or the tubes, the bed material is selected to be of an increased size, both in average diameter and density. Depending on the liquid, the size and density of the particles are selected so that they are sufficient to create liquid bubbles by their physical nature alone. Production of liquid bubbles, that is, liquid voids in the bed, will occur just because of the large differences in density between the particles in the bed material, and the liquid flowing therethrough. These liquid bubbles will agitate the particles in the same way as gas bubbles do in a gas fluidized bed with the consequence of vastly increased heat transfer rates.

The means of the invention utilizes a shell enclosure having a first liquid inlet and a first liquid outlet. A distributor plate extends through the shell and supports the bed material.

One or more tubes are positioned so as to extend through the shell bed material and themselves include bed material supported on a distributor plate. The distributor plate can be the same for both the shell and the tubes, and is permeable by liquids.

Each tube has a second liquid inlet and outlet. The inlets can be connected to a common header; as can the outlets if there is more than one tube. Depending upon the liquids utilized by the invention, different types of particles can be used for the beds in the tubes as opposed to the bed in the shell. Also, the flow of the first and second liquids can be adjusted to adjust the rate of heat transfer.

DETAILED DESCRIPTION OF THE PREFERRED EMBODIMENT

Figure 1:
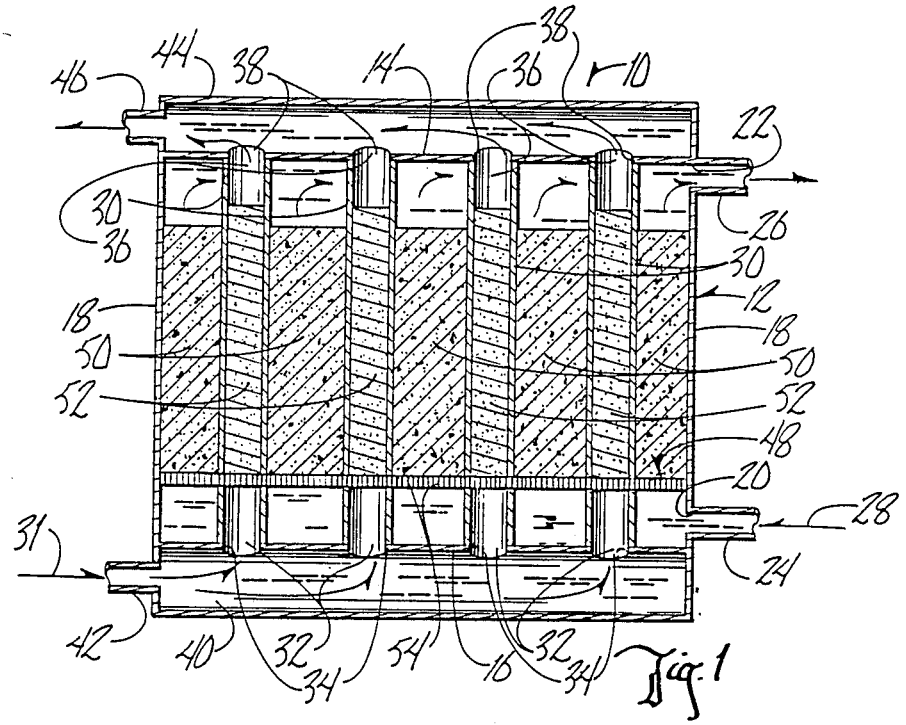
FIG. 1 is an elevated sectional view of one embodiment of the invention.

With reference to the accompanying drawing, a preferred embodiment of the invention will now be described. Most elements of the preferred embodiment will be designated by reference numerals, as indicated on FIG. 1.

FIG. 1 depicts, in elevated cross-section, heat exchanger 10. A shell 12 is defined by top wall 14, bottom wall 16, and continuous side wall 18, to define an enclosure.

Shell 12 is sealed except for shell inlet 20 and shell outlet 22. An inlet conduit 24 and an outlet conduit 26 are connected respectively to inlet and outlet 20 and 22. It is to be understood that inlet conduit 24 is connectable to a source of a first liquid 28, and outlet conduit 26 is connectable back to that source, or elsewhere, as desired.

Also, a plurality of tubes 30 extend through shell 12 and have open inlet ends 32 which extend through bottom openings 34 in shell 12; and have open outlet ends 36 extending through top openings 38 in shell 12. Tubes 30 basically extend from and through bottom wall 16, through the interior of shell 12, and up to and through top wall 14 of shell 12.

In the preferred embodiment shown in FIG. 1, a tube inlet header 40 encloses open inlet ends 32 of tubes 30, along bottom wall 16 of shell 12. Tube inlet header 40 is connected to inlet conduit 42 which is connectable to a source of a second fluid 31.

Similarly, a tube outlet header 44 covers open outlet ends 36 to tubes 30 along top wall 14 of shell 12, and has an outlet conduit 46 which is connected in fluid communication to a desired location. Both tube inlet and outlet headers 40 and 44 provide a common chamber for distribution to and from tubes 30, respectively.

A common distribution plate 48 extends laterally through both shell 12 and each of tubes 30 and abuts side wall 18 of shell 12. Distribution plate 48 supports bed material 50 in shell 12, and bed material 52 in each of tubes 30, yet is permeable by liquid which enters the respective beds through perforations 54 in plate 48. Distribution plate 48 therefore has to disallow passage of almost all of bed material 50 or 52 through it downwardly, while at the same time must allow passage of liquid upwardly sufficient to fluidize bed materials 50 and 52. Such distribution plates are well known within the art. Plate 48 can either have a large number of perforations, or can be made of a porous material.

It is important to note that the distribution plate 48 is positioned generally parallel to bottom wall 16, but is spaced above shell inlet 20. As can also be seen, bed material 50, even when fluidized, should not extend up to the level of shell outlet 22.

Plate 48 is also, therefore, above open inlet ends 32 of tubes 30. Bed material 52 in tubes 30 should not extend to open outlet ends 36 of tube 30, even when fluidized. It is therefore to be understood, as in conventional fluidization, both first and second liquids 28 and 31 are introduced to heat exchanger 10 at a sufficient flow rate so that fluidization of bed materials 50 and 52 occurs. First liquid 28 is generally evenly distributed along the bottom side of plate 48, flows through perforations 54 to the top side of plate 48, and proceeds to flow through bed material 50 with sufficient force and pressure to fluidize the particles in bed material 50. It then would collect and exit shell outlet 22.

Similarly, second liquid 31 would flow into tube inlet header 40 and be evenly distributed through open inlet ends 32 of tubes 30, flow through perforations 54 in those parts of plate 48 within tubes 30, fluidize bed material 52, flow out of open outlet ends 36, and be collected and flow out of tube outlet header 44.

The fluidization of bed material 50 and 52, by liquids 28 and 31, respectively, therefore creates an enhanced heat transfer environment. Fluidization of the various particles of bed material 50 and 52 cause agitation of the bed material particles, which strike one another, excitedly move within the liquid, and contact the walls of tubes 30. This enhances heat transfer over merely convection through the flow of liquid in a conduit or even a particulately fluidized bed that contains no liquid bubbles. Additionally, this preferred embodiment allows for the additional enhancement by production of gas bubbles due to phase change within the liquids as they flow, even further increasing heat transfer characteristics.

Heat exchanger 10 is versatile and adaptable to various types of liquid. If heat is to be transferred from liquid which is boiling, heat exchanger 10 allows the boiling liquid, with gas bubbles from the boiling, to be conducted through the respective bed material. The gas bubbles therefore increase agitation, enhancing heat transfer. Aggregative fluidization occurs. Heat may rise sufficiently, or already be sufficient to have boiling in the other liquid which serves only to again further enhance heat transfer.

When used with boiling liquids, the make-up of the bed material is not particularly critical. It is best, however, if it is granular and sand-like in its characteristics and size. Thus, bed material in the range of 0.1 millimeters to 1.0 millimeter diameter, with densities around 2,000 kilogram/meter cubed ($Kg/m^3$), would probably be sufficient for most boiling liquids.

However, if boiling is not desired or anticipated, or will not take place, heat exchanger 10 can still be adapted to enhance heat transfer by aggregative fluidization. The diameter and density of the bed material particles can be specifically selected for the type(s) of liquid(s) so that it is of a sufficient size and density to create liquid bubbles merely by the fluidization of liquid through it.

As previously stated, it is to be understood that if the density of the bed material is significantly different from the liquid being directed therethrough, liquid bubbles will form. Thus, in the case of water as liquid, it has been found that particles on the order of 1.0 millimeter in diameter, with densities over 7,800 kilogram/meter cubed ($kg/m^3$), works to produce liquid bubbles which will enhance heat transfer.

It is to be further understood that the included preferred embodiment is given by way of example only, and not by way of limitation to the invention. Variations obvious to one skilled in the art will be included within the invention defined by the claims.

For example, the size and shape of shell 12 or tubes 30 can take on many variations. Similarly, exchanger 10 can operate with just one tube 30, or many tubes 30. The orientation and size of tubes 30 can vary according to desire.

The size, density and consistency of bed material 50 and 52 can vary according to desired heat transfer characteristics.

What is claimed is:

1. A heat exchanger for enhanced heat exchange between first and second liquids comprising:

shell means forming an enclosure for containing a first liquid fluidized bed, and including a first liquid inlet and a first liquid outlet;

one or more tube means each forming an enclosure for containing a second liquid fluidized bed, each tube means including a second liquid inlet and a second liquid outlet;

first distributor plate means for supporting bed material in the shell means, the first plate means being permeable to liquids and being positioned in the shell means between the first liquid inlet and the bed material to distribute the first liquid throughout the bed material of the shell means;

second distributor plate means for supporting bed material in each tube means, the second plate means being permeable to liquids, and each tube means being positioned between the second liquid inlet and the bed material for the tube means to distribute the second liquid throughout the bed material of the corresponding tube means;

means for controlling rate of flow and pressure of the first liquid in the first liquid fluidized bed;

means for controlling rate of flow and pressure of the second liquid in the second liquid fluidized bed of each tube means;

means for creating aggregative fluidization in one or both of the first and second liquid fluidized beds by producing liquid bubbles in one or both of the first and second liquids; and the means for creating aggregative fluidization comprising means for causing boiling of one or both of the first and second liquids to produce liquid bubbles.

2. The heat exchanger of claim 1 further comprising a tube inlet header means for commonly connecting the second liquid inlets of each tube means to a common second liquid source.

3. The heat exchanger of claim 1 further comprising a tube outlet header means for commonly connecting the second liquid outlets for each tube to a common second liquid conduit.

4. The heat exchanger of claim 1 further comprising a tube inlet header means for commonly connecting second liquid inlets of the tube means to a common second liquid source; and a tube outlet header means for commonly connecting the second liquid outlets to a common second liquid conduit.

5. The heat exchanger of claim 1 wherein the first and second distributor plates comprise portions of a single distributor plate extending through the shell means and each tube means.

6. The heat exchanger of claim 1 wherein the shell means forming an enclosure comprises a top wall, bottom wall, and continuous side wall.

7. The heat exchanger of claim 6 wherein each tube means extends generally from the bottom wall to the top wall of the shell means.

8. The heat exchanger of claim 6 wherein the second liquid inlet for each tube means is positioned generally towards the bottom of the shell means, and the second liquid outlet for each tube means is positioned generally towards the top of the shell means.

9. The heat exchanger of claim 1 wherein the first liquid inlet is positioned towards the top of the shell means, and the first liquid outlet is positioned towards the bottom of the shell means, and the first liquid outlet is positioned towards the top of the shell means.

10. The heat exchanger of claim 1 wherein the first and second distributor plate means are porous.

11. The heat exchanger of claim 1 wherein the first and second distributor plate means are perforated.

12. A method of enhanced heat exchange between first and second liquids comprising:

selecting a first liquid according to heat transfer properties;

selecting a second liquid according to heat transfer properties;

selecting a first granular material according to average diameter and density;

selecting a second granular material according to average diameter and density;

fluidizing a bed of the first granular material with the first liquid in a shell container means;

fluidizing a bed of the second granular material with the second liquid in one or more tube container means, each positioned at least in part in the fluidized bed material of the shell container means;

circulating the first liquid through the shell container fluidized bed;

circulating the second liquid through the fluidized bed in each tube container means;

creating aggregative fluidization in one or both of the first and second liquid fluidized beds by producing liquid bubbles in one or both of the first and second liquids;

producing the liquid bubbles by selecting from the set comprising creating boiling in one or both first and second liquids, if the first or second granular material is below a certain average diameter and density; and controlling rate of flow and pressure of one or both of the first and second liquids if the average density of the first or second granular material is sufficiently different from the first or second liquids.

13. The method of claim 12 wherein the first liquid is, at least in part, boiling, and the bed material of particles has an average size of 0.1 millimeters to 1.0 millimeters in diameter, and an average density of approximately 2,000 kilograms/meter cubed.

14. The method of claim 13 wherein the bed material comprises sand-like particles.

15. The method of claim 12 wherein the first liquid is water.

16. The method of claim 15 wherein the bed material is made of particles generally larger than the range of 0.1 millimeters to 1.0 millimeters in diameter, and of density greater than 2,000 kilogram/meter cubed.

17. The method of claim 16 wherein the diameter of the bed material is generally 1.0 millimeters in diameter.

18. The method of claim 17 wherein the bed material is made of high density particles such as steel shot.

19. The method of claim 17 wherein the bed material is made of high density particles such as copper shot.

20. A method of enhanced heat exchange between first and second liquids comprising:

selecting a first liquid according to heat transfer properties;

selecting a second liquid according to heat transfer properties;

selecting a first granular material according to average diameter and density;

selecting a second granular material according to average diameter and density;

positioning the first granular bed material in a shell means;

positioning one or more tube means within the bed material of the shell means;

positioning the second granular bed material within each tube means;

directing the first liquid through the bed material of the shell means so as to fluidize the bed material;

directing the second liquid, different in average temperature than the first liquid, through the bed material of each tube means so as to fluidize the bed material in each tube means with the second liquid;

creating aggregative fluidization in one or both of the first and second liquid fluidized beds by producing liquid bubbles in one or both of the first and second liquids;

producing the liquid bubbles by selecting from the set comprising creating boiling in one or both first and second liquids, if the first or second granular material is below a certain average diameter and density; and controlling rate of flow and pressure of one or both of the first and second liquids if the average density of the first or second granular material is sufficiently different from the first or second liquids.

21. The method of claim 20 comprising the further step of causing one or both of first and second liquids to aggregatively fluidize to create liquid bubbles in the corresponding fluidized bed.

22. The method of claim 20 comprising the further step of selecting the size and density of the bed material so that the size and density is sufficient to create liquid bubbles in one or both of the fluidized beds.

* * * * *